US006082472A

United States Patent [19]

Verstraeten

[11] Patent Number: 6,082,472

[45] Date of Patent: Jul. 4, 2000

[54] EARTH DISPLACEMENT DRILL

[75] Inventor: Alexander Julien Verstraeten, AB Oostburg, Netherlands

[73] Assignee: Fundex N.V., Zeebrugge, Belgium

[21] Appl. No.: 09/008,116

[22] Filed: Jan. 16, 1998

[30] Foreign Application Priority Data

Jan. 22, 1997 [DE] Germany ..... 197 02 137

[51] Int. Cl.[7] ..... E21B 10/44

[52] U.S. Cl. ..... 175/323; 175/394

[58] Field of Search ..... 175/323, 394; D15/139

[56] References Cited

U.S. PATENT DOCUMENTS

| | | | |
|---|---|---|---|
| D. 183,237 | 7/1958 | Aven | D15/139 |
| 3,703,214 | 11/1972 | Boehm et al. | 175/395 |
| 4,623,025 | 11/1986 | Verstraeten | 175/21 |
| 4,949,795 | 8/1990 | McDonald et al. | 175/40 |

FOREIGN PATENT DOCUMENTS

| | | |
|---|---|---|
| 0588143 A1 | 3/1994 | European Pat. Off. . |
| 19 18 856 | 10/1969 | Germany . |
| 79 23 274 | 12/1979 | Germany . |
| 29 36 060 | 4/1981 | Germany . |
| 32 25 807 | 3/1983 | Germany . |
| 32 25 118 | 4/1983 | Germany . |
| 35 01 439 | 10/1983 | Germany . |
| 87 16 923 | 3/1988 | Germany . |
| 8716923 | 3/1988 | Germany . |
| 42 20 976 | 7/1993 | Germany . |
| 42 28 580 | 10/1993 | Germany . |

*Primary Examiner*—Eileen Dunn Lillis
*Assistant Examiner*—John Kreck
*Attorney, Agent, or Firm*—Fitch, Even, Tabin & Flannery

[57] ABSTRACT

An earth displacement drill is provided including a drill tube which can be driven for rotary movement and a boring tip connected thereto, wherein the boring tip has a cylindrical part which adjoins the drill tube and has at least two helical strips uniformly distributed around the circumference, which climb upwardly at a shallow angle, with the flat side of the strips preferably extending substantially parallel to the radius at the relevant position and in particular only over a fraction of the circumference of the cylindrical part. The boring tip also has a tapering part located beneath the cylindrical part and having at least two arched surfaces which are uniformly distributed around the tapering part. These arched surfaces expediently extend approximately parallel to the vertical and preferably more steeply than the helical strips. Moreover, they preferably extend only over a fraction of the periphery of the tapered part and terminate radially outwardly at least in the vicinity of the start of an associated helical strip. Such an earth displacement drill is improved in that the arched surfaces have lower edges which adjoin flat helical surfaces in a substantially step-free manner. The flat helical surfaces extend continuously to the lower edge of the cylindrical part and to the upper edge of the following arched surface as viewed opposite to the direction of rotation. The flat helical surfaces in each case form a step with the following arched surface as viewed opposite to the direction of rotation.

20 Claims, 4 Drawing Sheets

FIG. 2
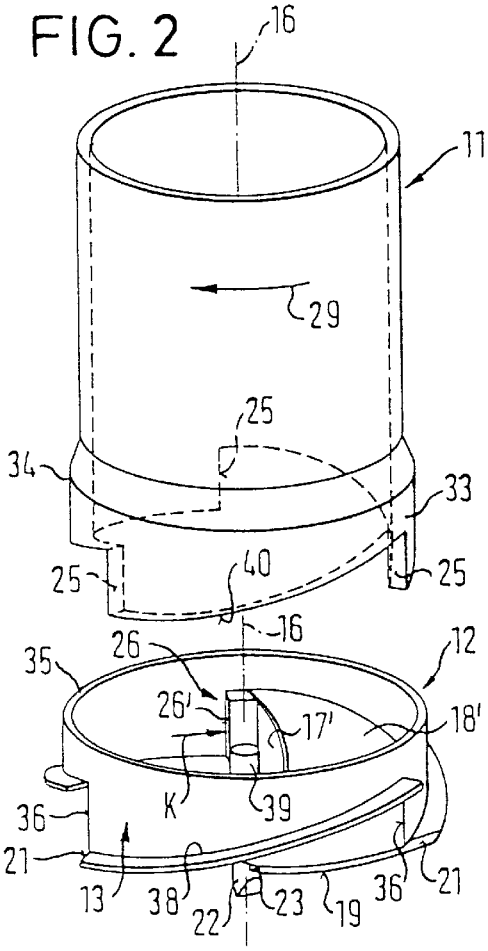
FIG. 5
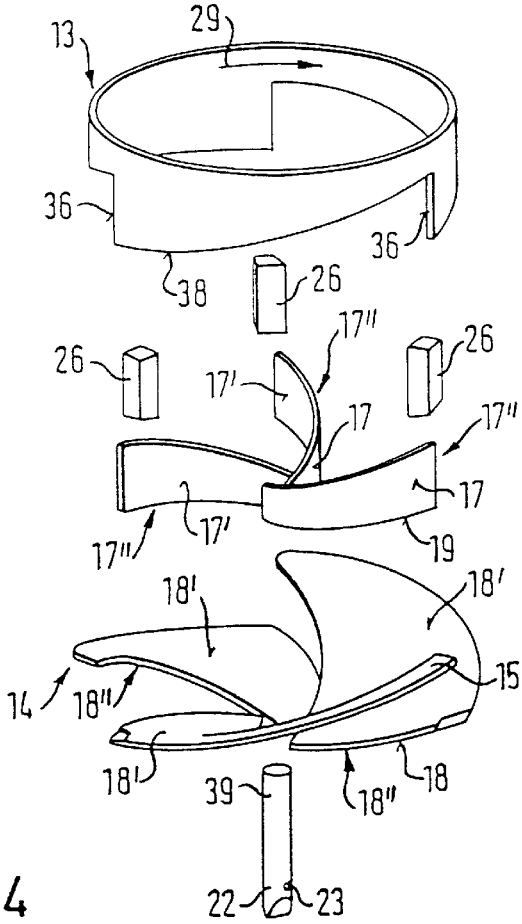
FIG. 3
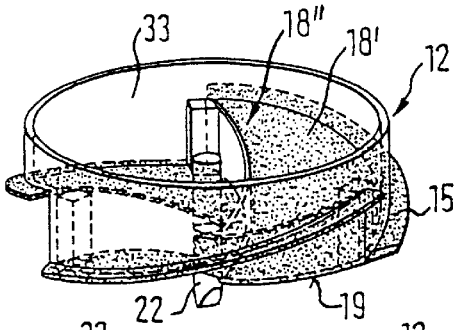
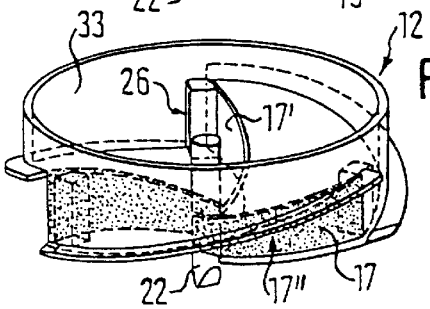
FIG. 4

EARTH DISPLACEMENT DRILL

FIELD OF THE INVENTION

The invention relates to an earth displacement drill comprising a drill tube which can be driven to execute a rotary movement and a boring tip or head which is rotationally connected or connectable thereto.

DESCRIPTION OF THE PRIOR ART

An earth displacement drill of this kind is known from DE 35 01 439 C2. Characteristic for this type of earth displacement drill is the division of the drilling tip into two different regions in the vertical direction of which the lower serves primarily to displace the earth radially from the inside to the outside and the upper serves to convey the earth from the bottom to the top along the drill tube. When, in the following description, the discussion is of the vertical or of the horizontal directions, then this assumes a vertical arrangement of the drill tube. It will, however, be understood that earth displacement drills in accordance with the invention are also suitable for the drilling in the earth of holes having an axis which includes an angle with the vertical direction.

In the earth displacement drill of DE 35 01 439 C" the boring tip has a cylindrical part which adjoins the drill tube and has at least two and preferably three helical strips which are arranged at the circumference. These helical strips are in particular uniformly distributed around the circumference, and climb upwardly at a shallow angle. The flat side of the strips preferably extends at least substantially parallel to the radius at the relevant position and extends in particular only over a fraction of the circumference of the cylindrical part. A tapering part is located beneath the cylindrical part and has at least two and preferably three arched surfaces which extend around the periphery, and which are in particular uniformly distributed around the periphery. These arched surfaces expediently extend at least approximately parallel to the vertical and preferably more steeply than the helical strips. The arched surfaces preferably extend only over a fraction of the periphery of the tapered part and preferably terminate radially outwardly at least in the vicinity of the start of an associated helical strip.

OBJECT OF THE INVENTION

The invention is based on the object of providing an earth displacement drill of the above named kind with even better drilling characteristics.

BRIEF DESCRIPTION OF THE INVENTION

In order to satisfy this object there is provided a drill of the above named kind wherein the arched surfaces have lower edges which adjoin flat helical surfaces in an at least substantially step-free manner, with the helical surfaces extending continuously to the lower edge of the cylindrical part and to the upper edge of the following arched surface as viewed opposite to the direction of rotation), with the flat helical surfaces in each case forming a step with the following arched surface, as viewed opposite to the direction of rotation.

The concept underlying the invention is thus to be seen in the fact that the space behind the arched surfaces in the known earth displacement drill when viewed in the direction of rotation is covered over by the helical surfaces, so that a uniform and continuous, at least substantially step-free transition is present from the lower edge of each arched surface to the upper edge of the arched surface following it opposite to the direction of rotation. In this manner, a situation is in particular avoided in which material can collect behind the arched surfaces.

Moreover, through the connection of the arched surfaces and the helical surfaces a particularly stable and tough drilling tip is formed so that a high strength can be obtained with a low use of material.

Preferred practical embodiments can be found from the patent claims 2 to 10.

The embodiments of claims 11 to 13 are furthermore expedient for ideal drilling characteristics.

In a preferred inventive design in accordance with claim 14 the axially projecting arched surfaces serve for the material transport radially outwardly, whereas the helical surfaces, which extend between sequential arched surfaces, ensure a uniform and continuous transition from the lower edge of one arched surface to the upper edge of the arched surface following it opposite to the direction of rotation.

Through the embodiments of claims 15 and 16 not only is material saved and the drilling tip thereby made particularly light, but rather abutment surfaces are also provided in accordance with claims 17 and 18 for the drivers on the drill tube which transmit the rotary movement.

Claim 19 gives expression to the fact that the cylindrical part preferably adopts a stepped shape in accordance with the number of arched surfaces that are present.

In accordance with the invention a helical surface and a helical strip are expediently associated with each individual arched surface.

BRIEF LISTING OF THE FIGURES

The invention will be described in the following by way of example with reference to the drawing in which are shown:

FIG. 1 a perspective view of the lower part of an earth displacement drill in accordance with the invention during operation in the earth, FIG. 2 a perspective view of a somewhat modified embodiment to a somewhat reduced scale in a dismantled state of the drill tube and drilling tip, with the helical strips in the circumferential direction being of shorter design than in the embodiment of FIG. 1, FIG. 3 a perspective view of a drill tip in accordance with the invention seen obliquely from above in analogy to FIG. 2, with the three helical surfaces being emphasised in the drawing, FIG. 4 the same perspective view of FIG. 3, with the arched surfaces formed in accordance with the invention being emphasised in the drawing, FIG. 5 a perspective exploded representation of a drilling tip in accordance with the invention to illustrate the individual parts from which it is put together, FIG. 6 a perspective view of a drilling tip in accordance with the invention seen obliquely from below, FIG. 7 a view of a drilling tip in accordance with the invention seen from below, FIG. 8 a view of a drilling tip in accordance with the invention seen from above, and FIG. 9 a schematic axial section of the drilling tip of the invention along the circle 24 in FIG. 7 developed into a straight line 24'.

DESCRIPTION OF PREFERRED EMBODIMENTS

Figure 1:
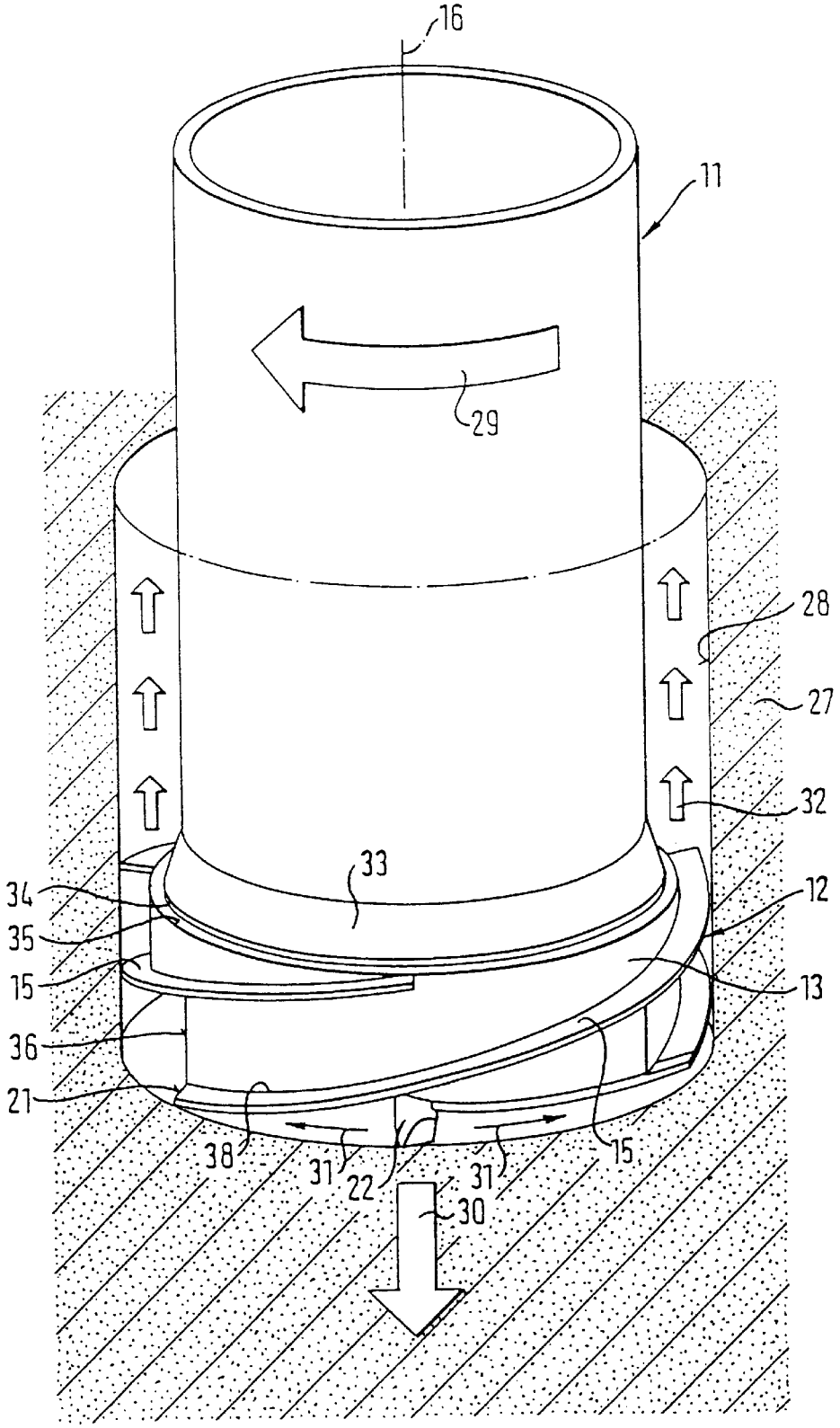

In accordance with FIG. 1 a hollow cylindrical drill tube 11 with a drilling tip 12 or head at the lower end is arranged within a vertical bore 28 with a vertical central axis 16 in the earth 27. At the top, the drill tube 11 extends beyond the surface of the earth and is driven there in non-illustrated manner so that it executes a rotary movement in the direction of the arrow 29. The drill is hereby advanced in the direction of the arrow 30 downwardly into the earth as a result of the weight of the earth displacement drill and of the design of the drilling tip 12 described in the following. The earth located beneath the drill is urged radially outwardly by the drilling tip 12 in the direction of the arrows 31 and is finally conveyed upwardly in the direction of the arrows 32 at and along the periphery of the drill tube 11. For this purpose the drilling head 12 has a somewhat larger outer diameter than the drill tube 11.

Figure 6:
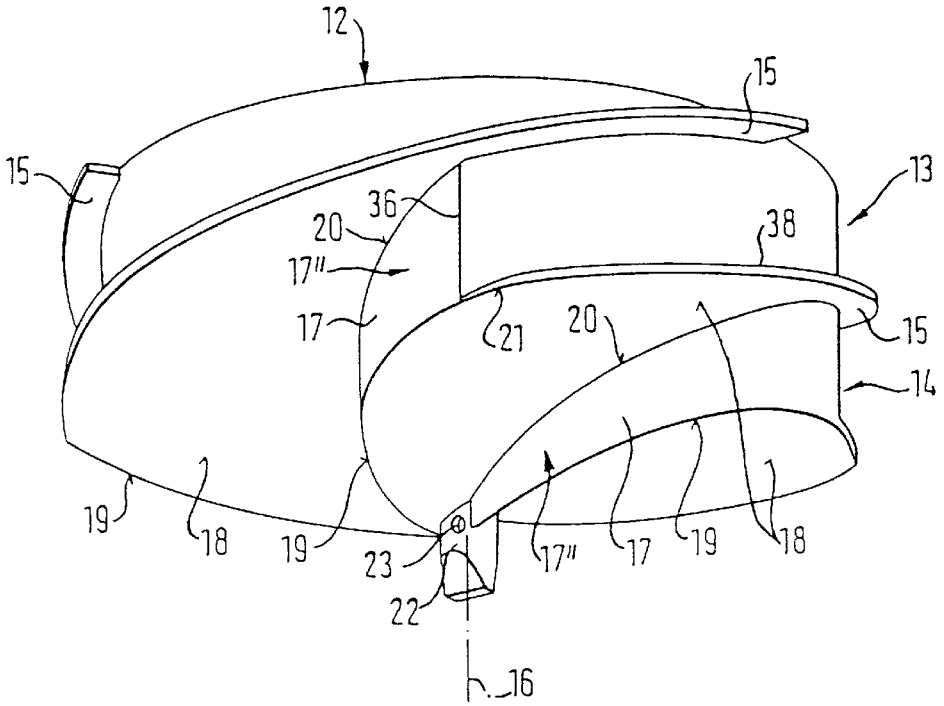

In accordance with FIGS. 1 to 5, and in particular in accordance with FIG. 6, the drilling tip 12 in accordance with the invention comprises an upper hollow cylindrical part 13 of circular cross-section which has a larger diameter than the drill tube 11. The right-cylindrical drill tube 11 is provided, in accordance with FIGS. 1 and 2, with a right-cylindrical driver part 33 of enlarged diameter at its lower end on which there are formed three vertically extending driver surfaces 25 which are uniformly distributed around the periphery at the saw tooth-like lower edge 40 of the drill tube 11. The outer diameter of the driver part 33 corresponds to the internal diameter of the cylindrical part 13, so that the driver part 33 can be pushed into the cylindrical part 13 from above in the manner which can be seen from FIG. 1. A nonillustrated ring seal can optionally be additionally provided between a step-like shoulder 34 at the start of the driver part 33 and the circular horizontal upper edge 35 of the cylindrical part 13 on which the shoulder 34 rests.

As can be seen from FIGS. 2 and 5 in particular, the cylindrical part 13 also has a saw tooth shape from which at least substantially corresponds to the saw tooth shape of the driver part 33 of the drill tube 11, with an edge 38 extending from each axially extending saw tooth step 36 obliquely upwardly in the peripheral direction, up to the upper end of the next saw tooth step 36 opposite to the direction of rotation 29. A radially outwardly projecting helical strip 15 preferably consisting of sheet steel is provided along the edge 38 and consists of a flat strip material, with the long side of the rectangular cross-section of the helical strip 15 in each case coinciding with the radius of the cylindrical part 13 at the relevant position. As can be seen particularly clearly from FIGS. 1 and 2, the helical strips 15 can extend from the lower end of each saw tooth step 36 continuously and at a small angle to the horizontal of approximately 15° up to the upper edge 35 of the cylindrical part 13 over an angle of more than 120°. In this case the helical strips in each case clearly overlap the lower lying and above lying helical strip 15 (FIG. 1). Alternatively, the helical strips only extend over an angle of 120° up to the following saw tooth step 36 in the peripheral direction, with no overlap being present between sequential helical strips 15 (FIG. 2).

The height of the saw tooth steps 36 amounts approximately to from 20 to 80%, and preferably to from 30 to 70%, and in particular to from 40 to 60% of the total height of the cylindrical part 13 at this position.

As can be seen particularly well from FIG. 6, a tapered part 14 adjoins the cylindrical part 13 at the bottom and has a substantially conical shape towards the bottom. However, the individual surfaces differ to a greater or lesser degree from a pure conical shape. The apex angle of the cone is of the order of 140°.

Convexly curved arched surfaces 17 extend substantially radially inwardly and obliquely downwardly from the lower end faces 21 of the flat helical strips 15 in the direction towards the central axis 16 of the cylindrical part 13. A drilling bit 22 is provided at the central axis and, in accordance with FIG. 2, communicates with an upper central tube 39 which is likewise coaxial to the central axis 16. The drilling bit 22 has lateral fluid outlet openings 23 in accordance with FIG. 6 which are in flow communication with the interior of the central tube 39. Thus, in as much as the central tube 39 is connected to a non-illustrated fluid supply line, which extends through the interior of the drill tube 11, a suitable fluid can be expelled from the fluid outlet openings 23 during the drilling procedure, for example a fluid which serves to consolidate the surrounding earth.

As one can see from FIG. 5, the arched surfaces 17 are formed on correspondingly shaped arched surface parts 17" of sheet steel, so that a correspondingly shaped concave arched surface 17' is present at the side of the arched surface 17" of sheet steel remote from the convex arched surface 17. The convex arched surface 17 is located at the side of the sheet steel part 17" which faces in the direction of rotation 29.

The lower edges 19 of the arched surface parts 17" of sheet steel, which broaden radially outwardly in the illustrated manner, are led radially outwardly to the lower end faces 21 of the helical strips 15 and fixedly attached thereto, for example by welding. Furthermore, the radially outer end face of the arched surface part 17" of sheet steel is fixedly connected to the cylindrical part 13, for example by welding, in the region of the saw tooth step 36. Radially inwardly and at the bottom there is likewise a firm connection, for example produced by welding, between the end face of the arched surface part 17" of sheet steel and the drill bit 22.

In accordance with the invention a helical surface 18 which generally follows the conical shape extends from the lower edge 19 of the arched surface part 17" of sheet steel, but deviates from the purely conical shape in such a way that it extends up to the upper edge of the arched surface part 17" of sheet steel following it opposite to the direction of rotation 29. It is connected there to the upper edge of the further arched surface part 17" of sheet steel, for example by welding, while forming an at least approximately rectangular step 20. Radially outwardly, the helical surface 18 merges, while forming a kink, into the lower edge 38 of the cylindrical part 13 located above it, from which the helical strip 15 projects radially. In this manner, the lower edge 19 of each arched surface part 17" of sheet steel is continuously fixedly connected, via a helical surface 18, which branches off from it at least substantially at right angles, to the upper edge of the arched surface part 17" of sheet steel following it opposite to the direction of rotation 29 and to the lower edge extending therebetween of the cylindrical part 13 located above it.

Figure 9:
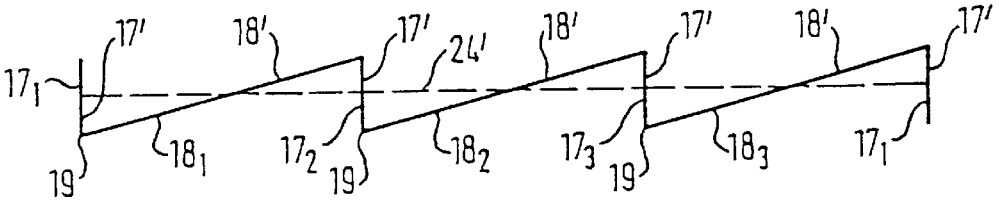

As a result of this design, a tapered part 14 arises beneath the cylindrical part 13 of which the arched surfaces 17 and the helical surfaces 18 have, in each axial section along a circle 24 (FIG. 7), substantially a shape such as can be seen from FIG. 9. Accordingly, a saw tooth shape pronounced to a greater or lesser degree arises around each imaginary circle 24 which is composed by the intersection lines of the arched surfaces 17 and of the helical surfaces 18.

Figure 7:
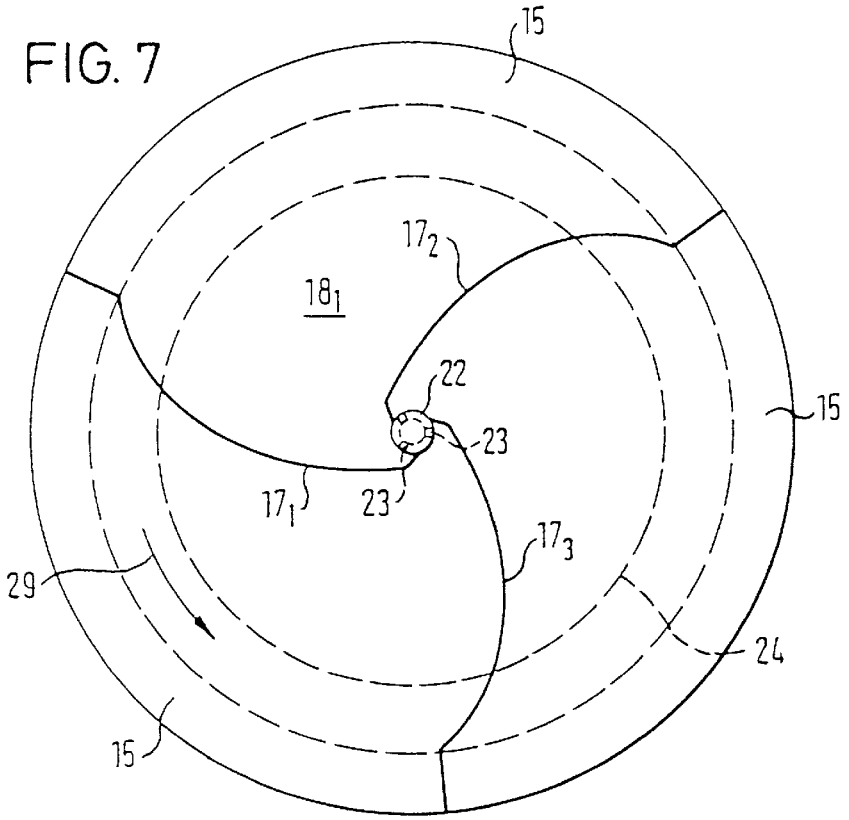

FIG. 9 also shows the profile of the drilling tip of the invention seen in the radial direction along the circle 24 in FIG. 7 which is developed into a straight line 24' in FIG. 9. From the lower edge 19 of the outer arched surface $\mathbf{17}_1$ the outer helical surface $\mathbf{18}_1$ extends obliquely upwardly to the foot of the further outer arched surface $\mathbf{17}_2$ following it opposite to the direction of rotation, with the next outer helical surface $18_2$, which extends up to the foot of the third outer arched surface $17_3$, again adjoining the lower edge 19 of the outer arched surface $17_2$. From the lower edge 19 of the third outer arched surface $17_3$, the third outer helical surface $18_3$ then again extends up to the foot of the first named outer arched surface $17_1$, where the 360° arc is closed.

In the embodiments shown in the drawing there are in each case provided three helical strips 15, three arched surface parts 17" of sheet steel, and three helical surfaces 18 uniformly distributed around the periphery of the drill tip 12. These elements are associated with one another in the manner shown.

Figure 8:
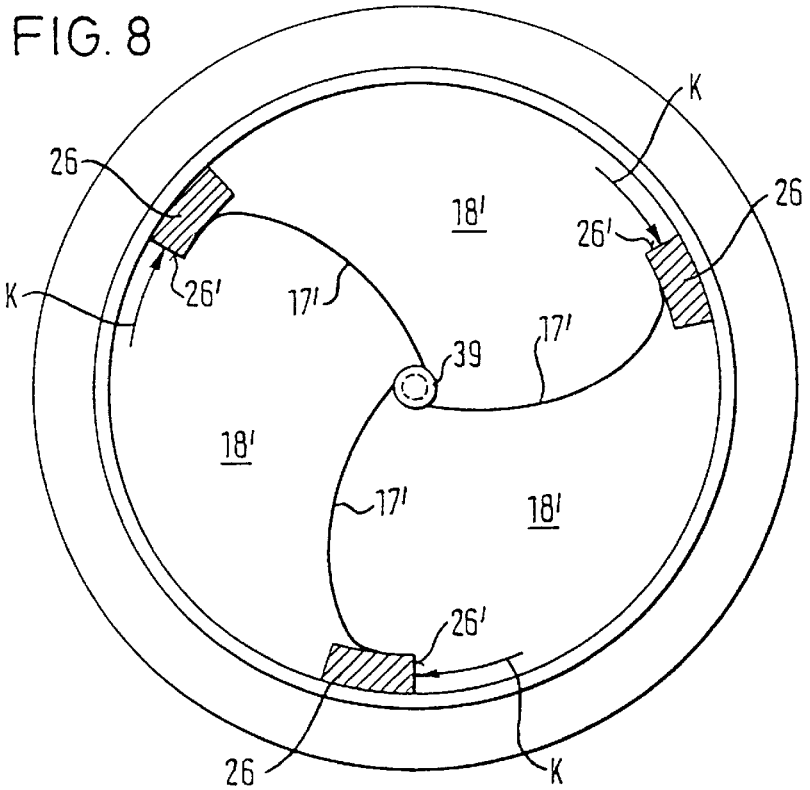

In accordance with FIGS. 2 and 5, the drill tip 12 is of hollow design. This is achieved not only in that the arched surfaces 17 are formed on arched surface parts 17" of sheet steel of restricted thickness, but rather in that the helical surfaces 18 are also formed on helical surface parts 18" of sheet steel of restricted thickness. Thus, in addition to the outer helical surfaces 18, there are also inner helical surfaces 18'. In this manner a follower structure arises within the interior of the drill tip 12 into which the driver part 33 can engage from above in accordance with FIG. 2. The drivers 25 then come into engagement in the peripheral direction with the radially outer ends of the inner arched surfaces 17', or with reinforcing blocks 26 provided there. The lower rising edges 40 of the saw tooth rim of the driver part 33 come into contact along regions of the helical surfaces 18' extending around the cylindrical part 13. In this way, a rotationally fixed connection is, on the one hand, produced between the drill tube 11 and the drilling tip 12. At the same time, the weight of the drill tube 11 is transmitted over a large area onto the drilling tip 12. The same parts which are used to improve the drilling action thus also serve for the transmission of higher torques from the drill tube 11 onto the drill tip 12 and for weight carrying. The total front surface 26' (FIGS. 2 and 8) of the reinforcing blocks 26 is thereby available for the exertion of a drive force K through the complementary surfaces of the drivers 25.

In accordance with FIG. 5 the helical strips 15 are directly connected to the helical surface parts 18" of sheet steel to form a constructional unit.

The manner of operation of the earth displacement drill described is as follows:

After the drill tube 11 has been axially plugged onto the drill tip 11 in accordance with FIG. 1, starting from the position of FIG. 2, the drill tip 12 is placed onto the earth 27 and the drill tube 11 is set rotating in the direction of the arrow 29.

During this, the drill bit 22 drills into the earth which then reaches the arched surfaces 17. As a result of their at least approximately radial shape which then increasingly adopts a peripheral component, the arched surfaces 17 convey the earth which has been engaged radially outwardly, where it finally reaches the upper surfaces of the helical strips 15 from which it is pressed upwardly in accordance with FIG. 1 in the direction of the arrow 32 along the drill tube 11.

In order to provide the corresponding free space around the drill tube 11, the cylindrical part 13 in accordance with FIG. 1 has a larger diameter than the drill tube 11, so that the helical strips 15 in particular can project significantly radially beyond the outer diameter of the drill tube 11.

The arched surfaces 17 have such a low curvature that they extend around the drill bit 22 only over an angle which lies substantially beneath 180° and preferably also significantly beneath 90°. They thus basically extend radially with an increasing peripheral component from the radially inner end to the radially outer end.

The helical surfaces 18 ensure that no material can be deposited in any form of hollow cavities behind the convexly curved arched surfaces 17 when seen in the direction of rotation 29 (FIG. 1), but rather reach the following arched surface 17 opposite to the direction of rotation and are then deflected radially outwardly at the latter.

As a result of the design of the invention the angle between the tangent to the lower end of the helical strip 15 and the upper end of the arched surface 17 amounts to between 100 and 140°, and preferably to approximately 120°. Thus, the earth which is conveyed radially outwardly is deflected relatively suddenly from a radial direction into an axial movement upwardly.

A substantial advantage of the arrangement of the invention lies in the fact that the drilling tips are even lighter and more economical in use. Through the shaping in accordance with the invention a high stability of the drilling tip is nevertheless achieved with a low use of material. As a result of the structure which results in accordance with the invention it is possible to avoid special driver cams in the interior of the hollow drilling tip which are very heavy.

Since the lower edge 19 of the arched surfaces 17 adjoins the front edge 21 of the helical strips 15 radially outwardly, the earth is transported directly from the arched surfaces 17 into the space above the helical strips 15, so that the transport path for the earth is extremely short. In this way, a higher drilling speed can be achieved.

Through contact of the lower edges 40 of the driver part 33 (FIG. 2) on the inner helical surfaces 18' an ideal axial force transmission is achieved from the drill tube 11 onto the drilling tip 12. In accordance with the invention provision can also be made for the arched surface parts 17" of sheet steel to be provided with teeth, at least in their lower region, in order to also be able to bore successfully in very hard ground.

An important feature of the invention lies in the fact that the height of the arched surfaces 17 or 17' increases continuously in the radial direction from the inside to the outside, whereby account is taken of the radially outwardly increasing quantity of material.

What is claimed is:

1. Earth displacement drill comprising a drill tube which can be driven to execute a rotary movement and a boring tip connected thereto for rotation therewith, wherein the boring tip has a cylindrical part with a circumference thereof and which adjoins the drill tube and has at least two helical strips which are arranged at the circumference and which climb upwardly at an angle, and wherein the boring tip also has a tapering part having a periphery thereof and located beneath the cylindrical part and having at least two arched surfaces which extend towards the periphery, wherein substantially flat helical surfaces including the helical strips are provided and the arched surfaces have lower edges which adjoin the flat helical surfaces in a substantially step-free manner, the cylindrical part including a lower edge thereof with the helical surfaces extending continuously to the lower edge of cylindrical part and to the upper edge of adjacent arched surfaces with each of the flat helical surfaces forming a step with the adjacent arched surface, as viewed opposite to the direction of rotation.

2. Earth displacement drill in accordance with claim 1, characterized in that the arched surfaces are curved about an axis extending substantially parallel to the vertical central axis, with the convex side of each surface facing in the direction of rotation.

3. Earth displacement drill in accordance with claim 1, characterized in that the arched surfaces start radially inwardly and generally at the bottom with an approximately radial course and make an angle of between approximately 5° and approximately 70° with the radius where the arched surfaces intersect the cylindrical part.

4. Earth displacement drill in accordance with claim 3 wherein the angle with the radius is between approximately 20° and approximately 40°.

5. Earth displacement drill in accordance with claim 1, characterized in that the height of the arched surface increases continually from the center of the drill towards the periphery of the drill.

6. Earth displacement drill in accordance with claim 1, characterized in that at least a portion of the lower edge of the arched surfaces adjoins at least a portion of the helical strips.

7. Earth displacement drill in accordance with claim 1, characterized in that the helix angle of the helical strip relative to the horizontal is in the range of between approximately 2° to approximately 30°.

8. Earth displacement drill in accordance with claim 7 wherein the helix angle is between approximately 5° and approximately 20°.

9. Earth displacement drill in accordance with claim 1, characterized in that the helix angle of the arched surfaces is greater at the periphery of the drill than at the center of the drill and the angle at the periphery is in the range of approximately 10° to approximately 40°, and the angle at the center is in the range of approximately 0° to approximately 15°.

10. Earth displacement drill in accordance with claim 1, characterised in that at least one of the lower edge of the arched surfaces and the upper edge of the arched surfaces which coincides with the step have a continuous course.

11. Earth displacement drill in accordance with claim 1, characterized in that the tapering part has a boring bit centrally at the bottom which has fluid outlet openings through which fluids can be brought into contact with the surrounding earth.

12. Earth displacement drill in accordance with claim 1, characterized in that the height of the arched surfaces in the radially outer region is approximately 2 to 6 times as large as in the radially inner region.

13. Earth displacement drill in accordance with claim 1, characterized in that the arched surfaces, when viewed from the top of the drill, do not overlap and do not extend over an arc of 120° relative to the central axis.

14. Earth displacement drill in accordance with claim 1, characterized in that the helical strips which follow one another in a circumferential direction about the central axis overlap when viewed from the top of the drill.

15. Earth displacement drill in accordance with claim 13, characterized in that each of the helical strips extend over an angle in the range of approximately 12° to approximately 180° about the cylindrical part.

16. Earth displacement drill in accordance will claim 1, characterized in that the drill tip is hollow and each arched surface and helical surface has inner and outer surfaces.

17. Earth displacement drill in accordance with claim 16 characterized in that the arched surfaces and helical surfaces are formed of sheet-steel parts which are welded together.

18. Earth displacement drill in accordance with claim 16, characterised in that the radially outer regions of the inner arched surface are formed as a abutment for drivers at the lower end of the drill tube.

19. Earth displacement drill in accordance with claim 18, characterised in that reinforcing blocks for the action of the drivers are provided at the radially outer regions of the inner arched surfaces.

20. Earth displacement drill in accordance with claim 1, wherein the cylindrical part has helical edges corresponding to the helical surfaces and vertical edges corresponding to the arched surfaces.

* * * * *